US009814916B2

(12) United States Patent
Chattaway et al.

(10) Patent No.: US 9,814,916 B2
(45) Date of Patent: Nov. 14, 2017

(54) FIRE SUPPRESSION SYSTEM AND METHOD

(71) Applicant: Kidde Graviner Limited, Slough (GB)

(72) Inventors: Adam Chattaway, Old Windsor (GB); Terry Simpson, Wake Forest, NC (US); Tadd F. Herron, Chocowinity, NC (US)

(73) Assignee: Kidde Graviner Limited (GB)

( * ) Notice: Subject to any disclaimer, the term of this patent is extended or adjusted under 35 U.S.C. 154(b) by 0 days.

(21) Appl. No.: 15/089,860

(22) Filed: Apr. 4, 2016

(65) Prior Publication Data

US 2017/0281997 A1 Oct. 5, 2017

(51) Int. Cl.
*A62C 35/64* (2006.01)

(52) U.S. Cl.
CPC ..... *A62C 35/645* (2013.01)

(58) Field of Classification Search
CPC ..... A62C 35/58; A62C 35/68; A62C 37/04; A62C 37/36; A62C 99/0009; A62C 99/0018; A62C 35/64; A62C 3/08
USPC ..... 169/43, 45, 47, 9, 11, 16, 17
See application file for complete search history.

(56) References Cited

U.S. PATENT DOCUMENTS

| | | | | |
|---|---|---|---|---|
| 6,095,251 | A | 8/2000 | Mitchell et al. | |
| 6,935,433 | B2 | 8/2005 | Gupta | |
| 7,343,981 | B2 * | 3/2008 | Nappa | C07C 45/58 169/11 |
| 8,733,464 | B2 | 5/2014 | Chattaway et al. | |
| 8,925,642 | B2 | 1/2015 | Meier et al. | |
| 9,033,061 | B2 | 5/2015 | Chattaway et al. | |
| 9,034,202 | B2 | 5/2015 | Mitchell et al. | |
| 9,072,921 | B2 | 7/2015 | Ribarov et al. | |
| 9,248,326 | B2 | 2/2016 | Meier et al. | |
| 2010/0236796 | A1 * | 9/2010 | Chattaway | A62C 37/44 169/46 |
| 2011/0297401 | A1 | 12/2011 | Rennie et al. | |
| 2012/0186835 | A1 | 7/2012 | Meier | |

FOREIGN PATENT DOCUMENTS

| | | |
|---|---|---|
| EP | 2740517 | 6/2014 |
| WO | 2005002968 | 1/2005 |

OTHER PUBLICATIONS

Extended European Search Report for European Application No. 17164853.8 completed Aug. 24, 2017.

* cited by examiner

*Primary Examiner* — Christopher Kim
(74) *Attorney, Agent, or Firm* — Carlson, Gaskey & Olds, P.C.

(57) ABSTRACT

A fire suppression system includes at least one first gas source containing an inert gas, at least one second gas source containing an organic halide gas, a distribution network connected with the first gas source and the second gas source to distribute the inert gas and the organic halide gas, and a controller. The distribution network includes a common manifold, input lines connecting the first gas source and the second gas source with the common manifold, output lines leading from the common manifold, and flow control devices. The controller is in communication with the distribution network and configured to distribute the inert gas responsive to a fire threat signal and determine whether to distribute the organic halide gas based upon a location of a fire threat.

16 Claims, 2 Drawing Sheets

FIRE SUPPRESSION SYSTEM AND METHOD

BACKGROUND

Fire suppression systems widely vary depending upon the location and expected type of fire threat. Generally, such systems may utilize water, wet chemical agents, dry chemical agents, or other fire suppressants. While each system shares the objective of fire suppression, the location of the system often limits the type of suppressant used.

Aircraft, buildings, and other structures that have contained areas have typically utilized halogenated suppressants, such as halons. Halogens are believed to play a role in ozone depletion of the atmosphere. While many systems for buildings or other land structures have replaced halon, space and weight limitations in aviation applications impede replacement.

SUMMARY OF THE INVENTION

A fire suppression system according to an example of the present disclosure includes at least one first gas source containing an inert gas, at least one second gas source containing an organic halide gas, a distribution network connected with the first gas source and the second gas source to distribute the inert gas and the organic halide gas. The distribution network includes a common manifold, input lines respectively connecting the first gas source with the common manifold and the second gas source with the common manifold, output lines respectively leading from the common manifold, flow control devices configured to control flow of the inert gas and the organic halide gas, and a controller in communication with the distribution network. The controller is configured to distribute the inert gas responsive to a fire threat signal and configured to determine whether to additionally distribute the organic halide gas based upon a location of a fire threat.

In a further embodiment of any of the foregoing embodiments, the flow control devices include input valves located, respectively, at the at least one first gas source and the at least one second gas source.

In a further embodiment of any of the foregoing embodiments, the flow control devices include output valves located, respectively, in the output lines.

In a further embodiment of any of the foregoing embodiments, the output valves are spaced apart from the common manifold.

In a further embodiment of any of the foregoing embodiments, the distribution system includes X number of input lines leading into the common manifold and Y number of output lines leading out from the common manifold, and Y is greater than X.

In a further embodiment of any of the foregoing embodiments, with respect to cross-sectional size, the common manifold is at least about 200% larger than each of the input lines.

In a further embodiment of any of the foregoing embodiments, with respect to cross-sectional size, the common manifold is at least about 200% larger than each of the output lines.

In a further embodiment of any of the foregoing embodiments, the output lines are connected with different fire suppression compartments.

In a further embodiment of any of the foregoing embodiments, the controller is configured to distribute the organic halide gas based upon a compartment size at the location of the fire threat.

In a further embodiment of any of the foregoing embodiments, the controller is configured to select which of a plurality of compartments to initially distribute the inert gas to based upon the location of a fire threat and, if the location is a cargo compartment, to distribute the organic halide gas after initially distributing the inert gas.

In a further embodiment of any of the foregoing embodiments, the controller is configured to adjust a flow rate of the inert gas and adjust a flow rate of the organic halide gas based upon a compartment size at the location of the fire threat.

A method according to an example of the present disclosure includes providing an inert gas contained in at least one first gas source and an organic halide gas contained in at least one second gas source. The first gas source and second gas source are connected to a distribution network that includes a common manifold, input lines that respectively connect at least one first gas source with the common manifold and second gas source with the common manifold, output lines that respectively lead from the common manifold, and flow control devices that are configured to control flow of the inert gas and the organic halide gas. The method involves, in response to a fire threat signal, distributing the inert gas is distributed through the distribution network to a location of a fire threat and determining whether to additionally distribute the organic halide gas based upon the location of the fire threat.

A further embodiment of any of the foregoing embodiments includes distributing the organic halide gas based upon a compartment size at the location of the fire threat.

A further embodiment of any of the foregoing embodiments includes distributing the organic halide gas after initially distributing the inert gas if the location of the fire threat is a cargo compartment.

In a further embodiment of any of the foregoing embodiments, based on the location of the fire threat, the inert gas and the organic halide gas are co-distributed.

A further embodiment of any of the foregoing embodiments includes controlling a flow of the organic halide with respect to a flow of the inert gas.

A further embodiment of any of the foregoing embodiments includes adjusting a flow rate of the inert gas and adjusting a flow rate of the organic halide gas based upon a compartment size at the location of the fire threat.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION

Figure 1:
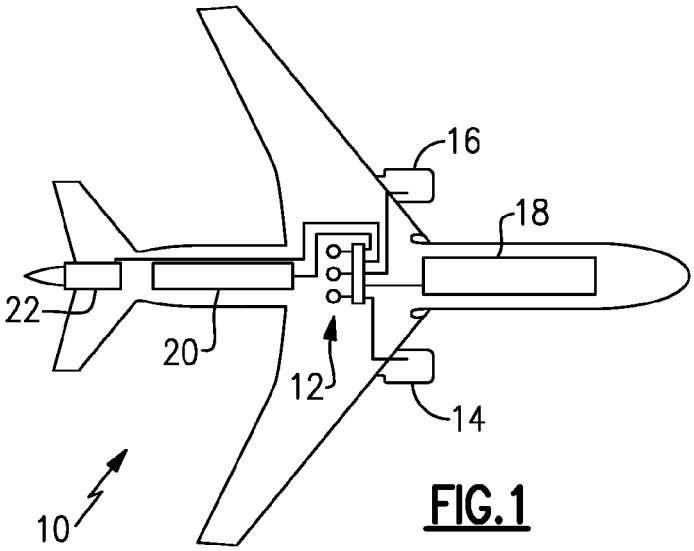
FIG. 1 illustrates an aircraft with a fire suppression system.

FIG. 1 illustrates an example aircraft 10 with a fire suppression system 12 that is configured to provide fire suppression to multiple different compartments 14/16/18/

20/22. In this example, compartments 14 and 16 are gas turbine engine compartments, compartment 18 is a forward cargo compartment, compartment 20 is an aft cargo compartment, and compartment 22 is an auxiliary power turbine engine unit. Such compartments 14/16/18/20/22 are of different volumetric sizes and may also have different fire suppression needs. Heretofore, such different compartments might have utilized their own dedicated independent halogen fire suppression system to individually address the particular size of the compartment and its suppression needs. However, the fire suppression system 12 is a single system that intelligently serves all of the compartments 14/16/18/20/22 and thus may be utilized to reduce cost and weight, and to partially replace use of halogenated suppressants.

Figure 2:
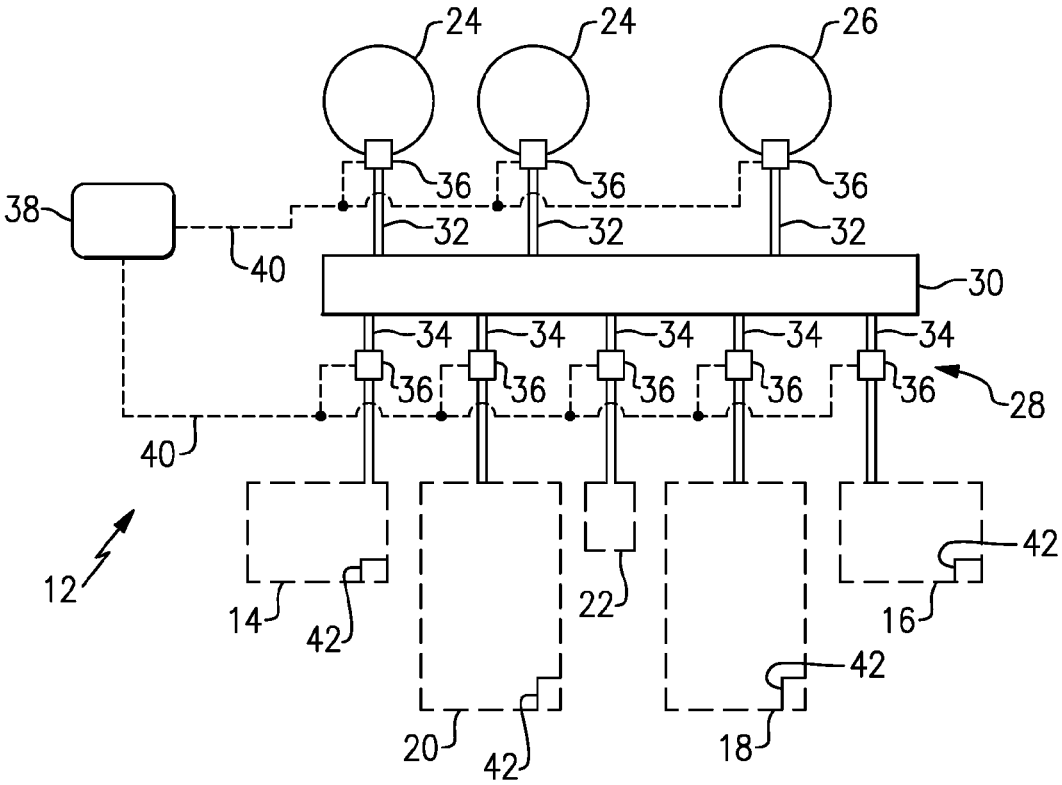
FIG. 2 illustrates an example of a fire suppression system.

FIG. 2 illustrates a schematic view of the fire suppression system 12 (hereafter "system 12"). The system 12 includes at least one first, high pressure or high flow gas source 24 (two shown) containing an inert gas and at least one second, low pressure or low flow gas source 26 containing an organic halide gas. Although the illustrated example depicts two of the first gas sources 24, a single first gas source 24 or additional first gas sources 24 could be used. Similarly, although the illustrated example depicts a single second gas source 26, additional second gas sources 26 could be used.

The phrases "high pressure" and "low pressure" may refer to the pressure under which the material is contained and/or to the maximum mass flow rate at which the gas can be provided. Thus, the high pressure gas source 24 is also considered to be a high flow rate gas discharge source, and the low pressure gas source 26 is also considered to be a low flow rate gas discharge source. Most typically, the high pressure gas source 24 and the low pressure gas source 26 will be gas tanks that are configured to contain and store the respective gases under flight conditions of the aircraft 10 if or until fire suppression is needed. For example, the inert gas is nitrogen, helium, argon, carbon dioxide, or mixtures thereof, and the organic halide gas is bromotrifluoromethane. Bromotrifluoromethane is also known as "halon" or "halon 1301."

The system 12 further includes a distribution network 28 that is connected with the high pressure gas source 24 and the low pressure gas source 26 to selectively distribute the inert gas and/or the organic halide gas to the compartments 14/16/18/20/22. The distribution network 28 includes a common manifold 30, input lines 32 that connect the high pressure gas sources 24 and the low pressure gas source 24 with the common manifold 30, output lines 34 that lead from the common manifold 30 to the compartments 14/16/18/20/22, and flow control devices 36.

As an example, the common manifold 30 is of a larger size than the individual input lines 32 and output lines 34. For instance, the common manifold 30 has a cross-sectional size and each of the individual input lines 32 and output lines 34 have a cross-sectional size such that the cross-sectional size of the common manifold is at least about 200% larger than the cross-sectional size of the individual input lines 32 and output lines 34. Such size differential could be varied to 125%, 150%, 175%, or up to 500%.

In a further example, the distribution system 28 includes X number of input lines 32 that lead into the common manifold 30 and Y number of output lines 34 that lead out from the common manifold 30. Although not limited, in one example, Y may be greater than X. In the illustrated example, X is 3 and Y is 5, for a ratio of 3:5. In modified examples that have different numbers of compartments and/or gas sources, the ratio is 3:4, 2:3, 2:4, 2:5, or Y is less than or equal to X.

The flow control devices 36 are configured to control flow of the inert gas and the organic halide gas in the distribution network 28. For example, the flow control devices 36 may be valves that are configured to open and close flow, metering valves that are configured to control mass flow, check valves, or combination valves that serve multiple functions of opening/closing, metering, and preventing backflow.

In the example shown, there is a respective flow control device 36 located at each of the high pressure gas sources 24 and at the low pressure gas source 26. These flow control devices 36 may be on or integrated with the gas tanks, for example. There is also a respective flow control device 36 located in each output line 34, spaced apart from the common manifold 30, for example. These flow control devices serve to open and close flow from the common manifold 30 to the respective compartments 14/16/18/20/22 and may also serve to control mass flow.

The system 12 also includes a controller 38. The controller 38 may include software, hardware (e.g., one or more microprocessors), or both that is configured or programmed to perform the functions described herein. The controller 38 is in communication with the distribution network 28. For example, the controller 38 is in communication with each of the flow control devices 36, as represented by communication lines 40. As will be appreciated, the controller 38 may also be in communication with other systems or controllers of the aircraft 10.

Figure 3:
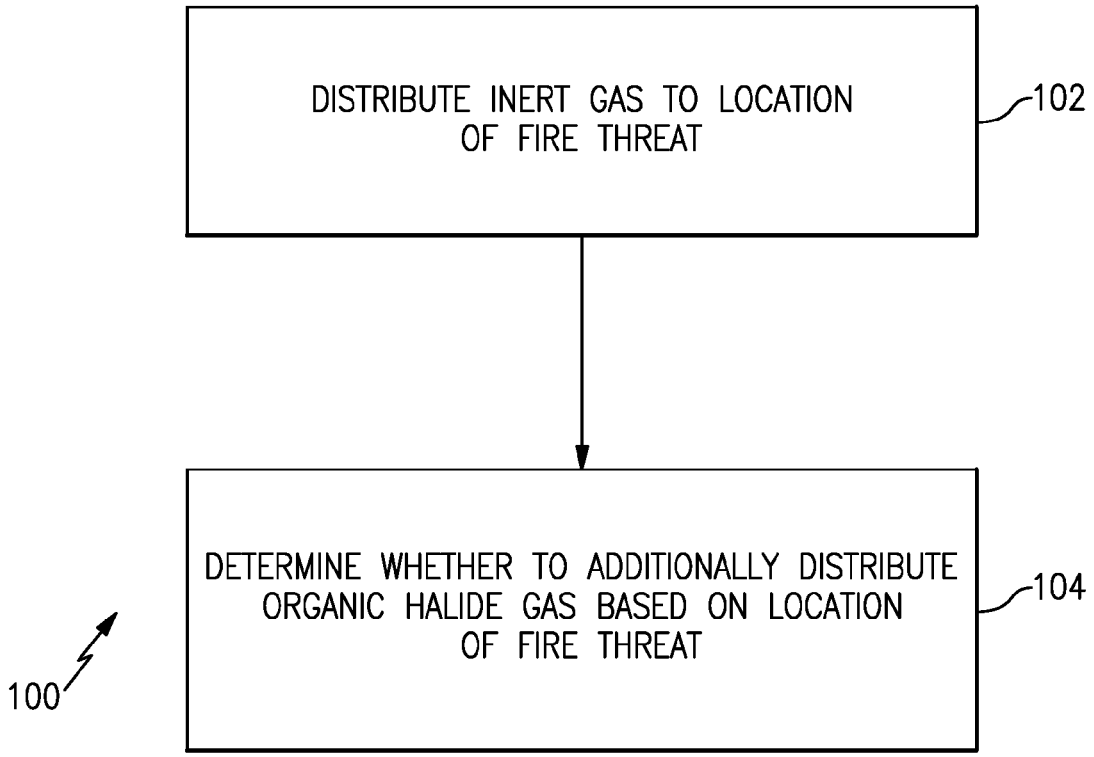
FIG. 3 illustrates a method for use with a fire suppression system.

As shown in a block diagram method 100 in FIG. 3, the controller 38 is configured at 102 to distribute the inert gas responsive to a fire threat signal and at 104 configured to determine whether to distribute the organic halide gas based upon a location of a fire threat. For example, each compartment 14/16/18/20/22 may have a detection system 42 that is capable of detecting whether there is a fire threat in the given compartment 14/16/18/20/22. Such detection systems 42 are generally known and are thus not described further herein. When a threat is detected, a signal is communicated to the controller 38. The controller 38 then distributes the inert gas to the given compartment 14/16/18/20/22 of the fire threat, and depending on the compartment 14/16/18/20/22, additionally distributes the organic halide gas after initially distributing the inert gas. In this regard, the controller 38 may be pre-programmed with information or look-up tables that the controller 38 uses to control how the inert gas is distributed and whether and how the organic halide gas is distributed. Additionally, the distribution may be based upon the size of the compartment 14/16/18/20/22. For example, the controller 38 is pre-programmed to distribute the inert gas for all the engine compartments 14/16/18/20/22 and to additionally distribute the organic halide gas for fewer than all of the compartments 14/16/18/20/22, such as to the forward and aft cargo compartments 18/20.

The controller 38 also selects through which of the output lines 34 the inert gas and the organic halide gas, if used, are distributed based upon the location of the fire threat with respect to the compartments 14/16/18/20/22. The controller 38 thus identifies which of the flow control devices 36 are to be controlled as well as what state—open or closed—the devices 36 are to be in such that the inert gas and the organic halide gas, if used, are distributed to the proper compartment 14/16/18/20/22 that has the fire threat.

As a further example, in an initial default state, all of the flow control devices 36 are closed such that there is no flow through the system 12. Given a fire threat in one of the compartments 14/16/18/20/22, the controller 38 opens the flow control device 36 of the selected one of the high pressure gas source 24 or the low pressure gas source 26, and opens the flow control device 36 in the corresponding output line 34 that leads to that compartment. Given that the different compartments 14/16/18/20/22 may be different in size, the amount of inert gas and organic halide gas, and flow rates, may be adjusted according to the amount needed and the maximum flow rate for the size of the compartment 14/16/18/20/22. For example, higher flow rates may be used for larger compartments 14/16/18/20/22 and lower flow rates for relatively smaller compartments. In this regard, each of flow control devices 36 in the output lines 34 may be sized according to the requirements of the compartment 14/16/18/20/22 being protected. The gas from either the high pressure gas source 24 or the low pressure gas source 26 flows into the common manifold 30 and then into the output line 34 that leads to that compartment 14/16/18/20/22.

For compartments 14/16/18/20/22 that utilize both the inert gas and the organic halide gas, the controller 38 may open the flow control devices 36 of both the high pressure gas source 24 and the low pressure gas source 26 such that the gases are co-distributed. Alternatively or additionally, the controller 38 may open the flow control devices 36 of the high pressure gas source 24 and the low pressure gas source 26 in a sequential or time-coordinated manner, control flow of the inert gas and the organic halide gas with respect to oxygen concentration in the given compartment 14/16/18/20/22, control flow of the organic halide with respect to the flow of the inert gas, or control flow the organic halide gas with respect to inert gas concentration in a given compartment 14/16/18/20/22 where there is a fire threat.

The common manifold 30 permits the high pressure gas source 24 and the low pressure gas source 26, or multiples of these, to be integrated into a single, compact system. For instance, the common manifold 30 may reduce the need for splits in the lines and additional line length that would otherwise add cost and weight. The common manifold 30 also permits each gas to be rapidly provided on-demand to any of the compartments 14/16/18/20/22, and thus reduces or eliminates the need for individual dedicated systems.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can be determined by studying the following claims.

What is claimed is:

1. A fire suppression system comprising:

at least one first gas source containing an inert gas;

at least one second gas source containing an organic halide gas;

a distribution network connected with the at least one first gas source and the at least one second gas source to distribute the inert gas and the organic halide gas, the distribution network including, a common manifold, input lines respectively connecting the at least one first gas source with the common manifold and the at least one second gas source with the common manifold, output lines respectively leading from the common manifold to a plurality of compartments, and flow control devices configured to control flow of the inert gas and the organic halide gas; and a controller in communication with the distribution network, the controller configured to independently distribute the inert gas to each one of the compartments responsive to a fire threat signal corresponding to a fire threat in each one of the compartments and configured to determine whether, and at what flow rate, to additionally distribute the organic halide gas to the compartment with the fire threat based upon a compartment size of the compartment with the fire threat.

2. The fire suppression system as recited in claim 1, wherein the flow control devices include input valves located, respectively, at the at least one first gas source and the at least one second gas source.

3. The fire suppression system as recited in claim 2, wherein the flow control devices include output valves located, respectively, in the output lines.

4. The fire suppression system as recited in claim 3, wherein the output valves are spaced apart from the common manifold.

5. The fire suppression system as recited in claim 1, wherein the distribution system includes X number of input lines leading into the common manifold and Y number of output lines leading out from the common manifold, and Y is greater than X.

6. The fire suppression system as recited in claim 1, wherein, with respect to cross-sectional size, the common manifold is at least about 200% larger than each of the input lines.

7. The fire suppression system as recited in claim 1, wherein, with respect to cross-sectional size, the common manifold is at least about 200% larger than each of the output lines.

8. The fire suppression system as recited in claim 1, wherein the output lines are connected with different fire suppression compartments.

9. The fire suppression system as recited in claim 1, wherein the controller is configured to select which of a plurality of compartments to initially distribute the inert gas to based upon the location of a fire threat and, if the location is a cargo compartment, to distribute the organic halide gas after initially distributing the inert gas.

10. The fire suppression system as recited in claim 1, wherein the controller is configured to adjust a flow rate of the inert gas and adjust a flow rate of the organic halide gas based upon a compartment size at the location of the fire threat.

11. The fire suppression system as recited in claim 1, wherein the flow control devices include input valves located, respectively, at the at least one first gas source and the at least one second gas source, the flow control devices include output valves located, respectively, in the output lines, and the distribution system includes X number of input lines leading into the common manifold and Y number of output lines leading out from the common manifold, and Y is greater than X.

12. A method comprising:

providing an inert gas contained in at least one first gas source and an organic halide gas contained in at least one second gas source, wherein the at least one first gas source and the at least one second gas source are connected to a distribution network that includes a common manifold, input lines that respectively connect the at least one first gas source with the common manifold and the at least one second gas source with the common manifold, output lines that respectively lead from the common manifold to a plurality of compartments, and flow control devices that are configured to control flow of the inert gas and the organic halide gas; and responsive to a fire threat signal corresponding to a fire threat in one of the compartments, independently distributing the inert gas through the distribution network to the compartment with the fire threat; and determining whether, and at what flow rate, to additionally distribute the organic halide gas to the compartment with the fire threat based upon a compartment size of the compartment with the fire threat.

13. The method as recited in claim 12, including distributing the organic halide gas after initially distributing the inert gas if the location of the fire threat is a cargo compartment.

14. The method as recited in claim 12, wherein, based on the location of the fire threat, the inert gas and the organic halide gas are co-distributed.

15. The method as recited in claim 14, including controlling a flow of the organic halide with respect to a flow of the inert gas.

16. The method as recited in claim 12, including adjusting a flow rate of the inert gas and adjusting a flow rate of the organic halide gas based upon a compartment size at the location of the fire threat.

* * * * *